United States Patent [19]

Jung

[11] Patent Number: 4,708,042

[45] Date of Patent: Nov. 24, 1987

[54] PUNCHING MACHINE

[75] Inventor: Klaus Jung, Pirmasens, Fed. Rep. of Germany

[73] Assignee: Schön & Cei, GmbH, Pirmasens, Fed. Rep. of Germany

[21] Appl. No.: 856,211

[22] Filed: Apr. 28, 1986

[30] Foreign Application Priority Data

Apr. 26, 1985 [DE] Fed. Rep. of Germany ..... 3515112

[51] Int. Cl.[4] ..... B21D 28/34

[52] U.S. Cl. ..... 83/112; 83/123; 83/155; 83/165; 83/255; 83/560; 83/685; 83/549

[58] Field of Search ..... 83/255, 560, 685, 549, 83/123, 97, 112, 155, 165, 687

[56] References Cited

U.S. PATENT DOCUMENTS

| | | | |
|---|---|---|---|
| 2,431,528 | 11/1947 | Wells et al. | 83/560 X |
| 2,674,311 | 4/1954 | Griswold | 83/123 X |
| 3,982,457 | 9/1976 | Berry | 83/560 X |
| 4,475,424 | 10/1984 | Kouno et al. | 83/549 |

*Primary Examiner*—Donald R. Schran

*Attorney, Agent, or Firm*—Wenderoth, Lind & Ponack

[57] ABSTRACT

With a punching machine with at least one punching carriage, which can be moved transverse to the advance direction of a material belt, with a piston cylinder unit arranged in the punching carriage, which effects the punching stroke of a tool stamp and, with an abutment for receiving a tool die-plate, it should be guaranteed that, a female die is always realized absolutely exactly below the punching material opposite the male die. This is achieved in that, the abutment is firmly arranged in a defined position to the piston cylinder unit in the punching carriage carrying the piston cylinder unit.

5 Claims, 7 Drawing Figures

PUNCHING MACHINE

DESCRIPTION

Figure 1:
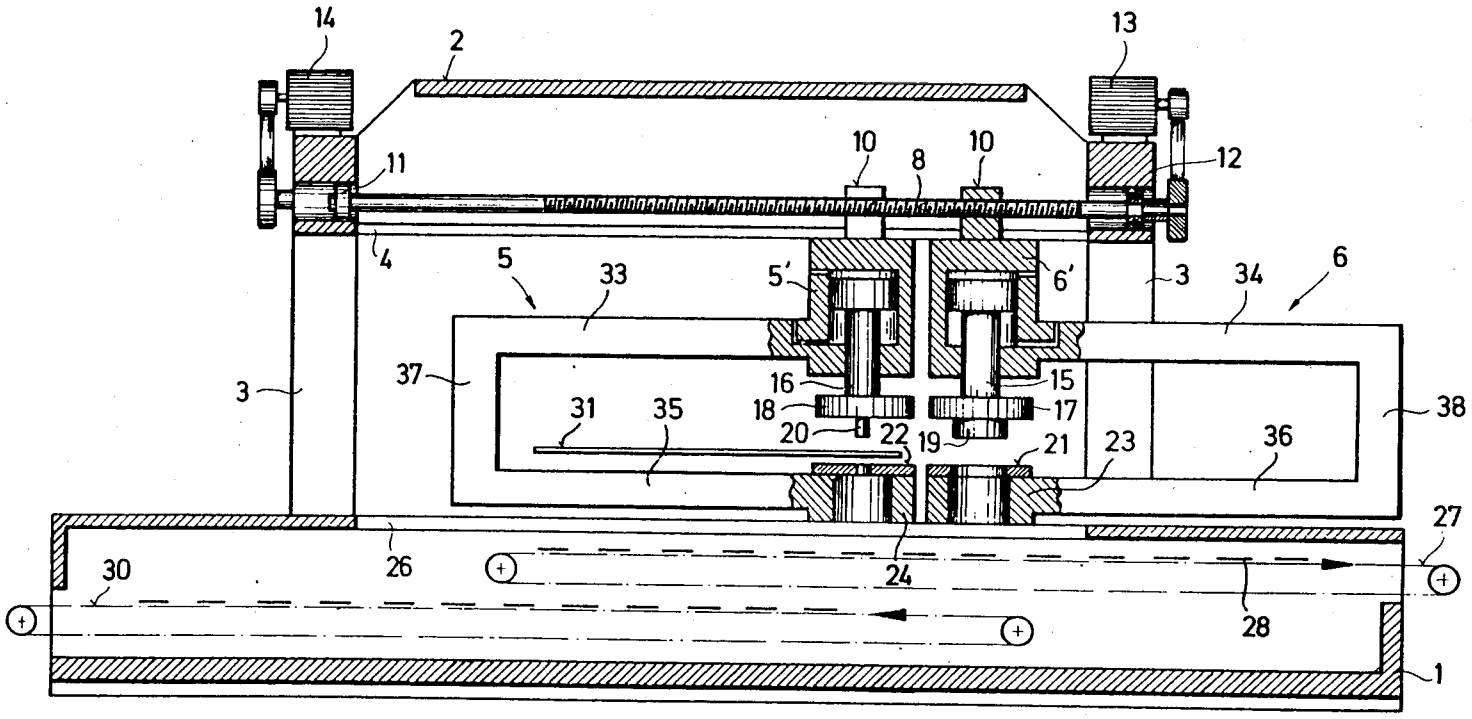

The invention relates to a punching machine with at least one punching carriage, which can be moved transverse to the advance direction of a material belt, with a piston cylinder unit arranged in the punching carriage, which effects the punching stroke of a tool stamp and, with an abutment for receiving a tool die-plate.

Such punching machines serve preferably to punch out rounds from belt wares. In connection with a corresponding transport arrangement, however, curves are also worked therewith.

With correspondingly large piece numbers belts are punched economically in such a way that, in an automatic punching machine of corresponding breadth a multitude of tools are arranged next one another, so that per belt advance a whole series are punched simultaneously. Because of the considerable tool costs and the multitude of tools needed, such a manner of working is not economically justifiable for the case that, only relatively small piece numbers are needed. In these cases only a single tool is used for the relevant size of punch-out, which punches in each case individual parts out of a narrow band, either automatically or through hand operation.

So-called carriage punches are also known, with which a cylinder with a tool receiving plate moves transverse to the advance direction over a material belt and realizes with an individual tool punch after punch. These machines use simple cutting tools, which punch on a counter-punch of steel or synthetic material.

In contrast, the punching machine according to the invention is provided for the application of cutting tools with male and female die. The lower tool is located thereby below the material belt. It has turned out that, a separate spindle driving gear for the lower tool does not guarantee any synchronised advance with the upper spindle because of the unavoidable play between the two driving gears.

It is the object of the invention, therefore, to develop a punching machine of the type named at the start, so that the female die is realized absolutely exactly below the punching material, opposite the male die.

This object is achieved, according to the invention, in that, the abutment is firmly arranged in a defined position to the piston cylinder unit in the punching carriage carrying the piston cylinder unit. Since, therewith, the lower tool can be immovably attached exactly opposite the upper tool, it is guaranteed that, the female die can be realized exactly above a male die.

According to a particularly advantageous design of the object of the invention, it is provided that the punching carriage is developed u-shaped, in which case the piston cylinder unit is arranged at the free end of the leg lying above and the abutment at the free end of the leg lying below, of the u-shaped punching carriage. The lower tool, namely the tool die-plates fastened to the abutments thus let themselves be attached exactly opposite the upper tool, namely aligned to the tool stamp.

So that with sideways moving the breadth of the material belt can be driven over, it is provided in further development of the object of the invention, that the legs are developed so long that, the total breadth of the material belt can be driven over by the punching carriage. The distance between the middle of the tool stamp and the outermost inner end of the linking part between the legs of the punching carriage corresponds according to the invention roughly to the material belt breadth minus half the tool diameter.

If discs with an inner hole must be punched, according to a preferred design of the invention two punching carriages are provided. With this punching-out the inner hole can be punched out with one punching carriage and with the other following punching carriage the discs at the outer diameter.

It has proved convenient that, each punching carriage is allocated its own driving gear for the drive movement.

In order to be able to carry off both the punched parts as well as the waste easily out of the area of the punching machine, according to yet a further design of the invention, transport bands are provided below the punching carriage route, of which one serves to receive the punched parts and the other to receive the waste. The transport band for the waste is arranged set at a distance from the transport band for the punched parts, in which case the waste gets past the transport band for the punched parts, onto the waste transport band, via a slide attached to the punching carriage.

Figure 2:
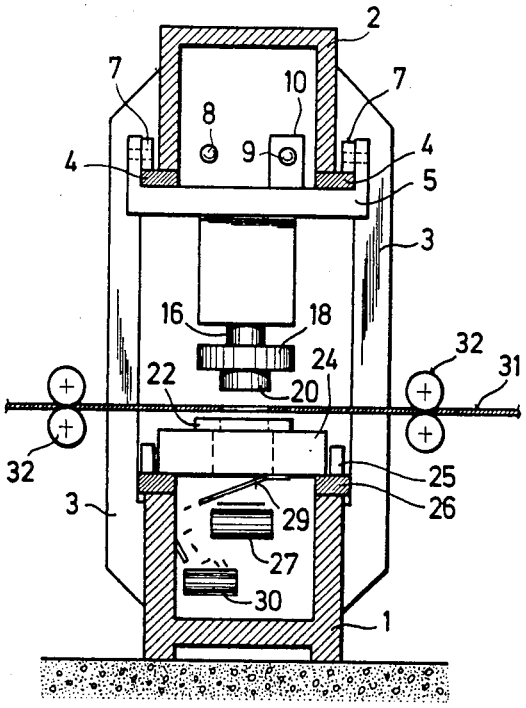
Figure 3:
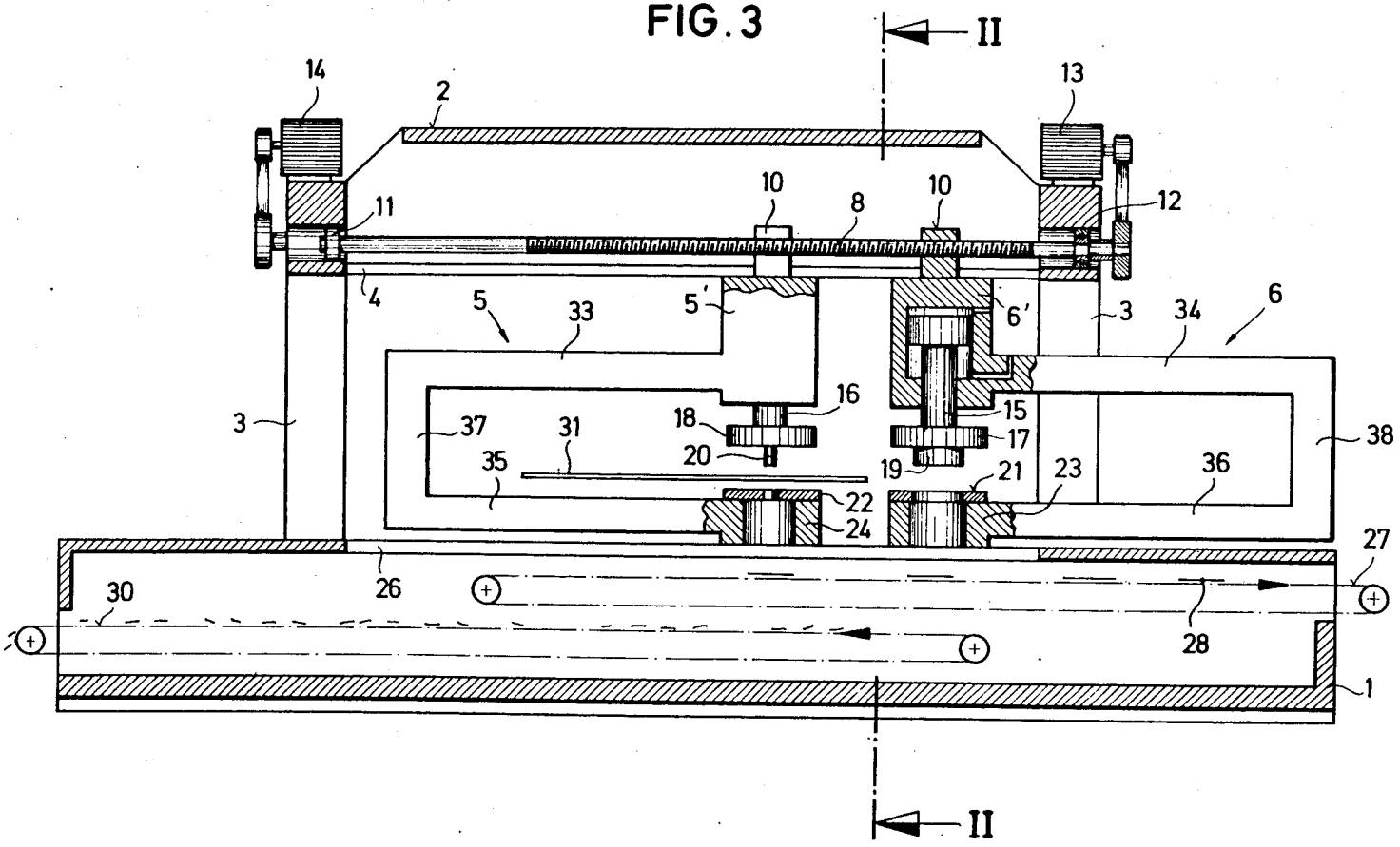
Figure 4:
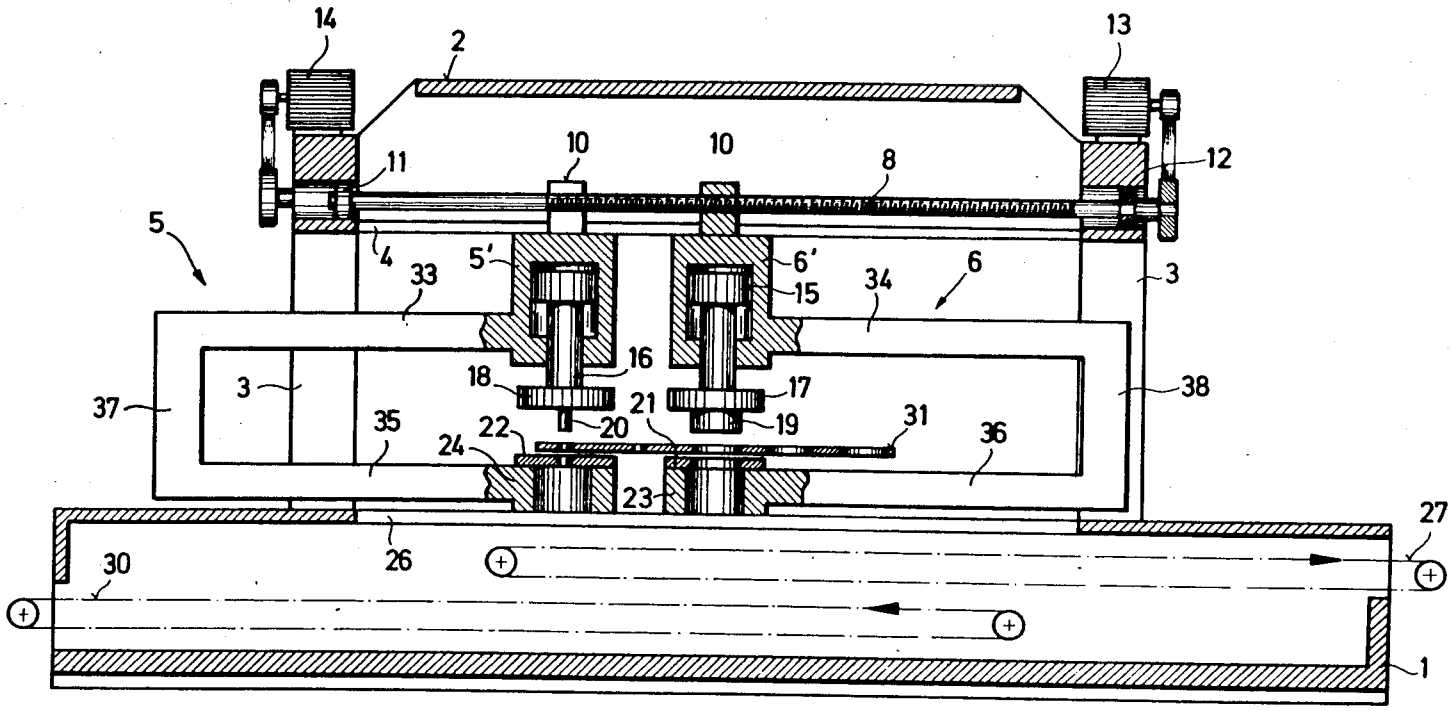
Figure 5:
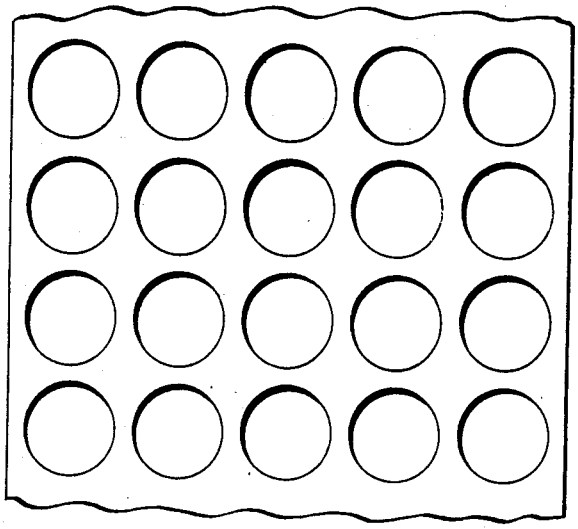
Figure 6:
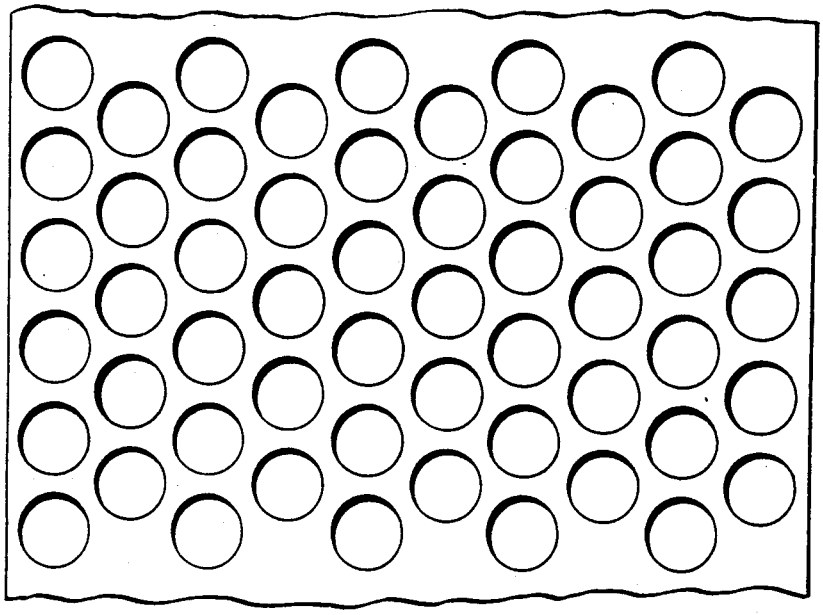
Figure 7:
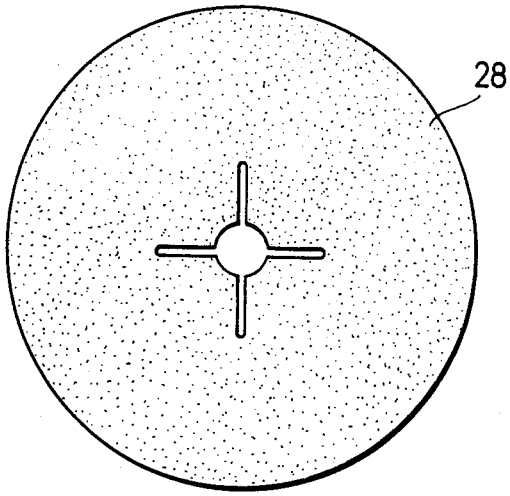

The invention is explained more closely in the following supported by an exemplary embodiment which is portrayed in the drawing. There is shown in:

FIG. 1 in schematic and partly sectioned portrayal, a view of a punching machine according to the invention from the front, FIG. 2 a cross-section through the punching machine shown in FIG. 1, FIG. 3 a portrayal corresponding to FIG. 1 of the punching machine, with which the left punching carriage has already carried out a punch, FIG. 4 a portrayal according to FIG. 3, with which both punching carriages are in application, FIG. 5 a material belt with punchings-out, FIG. 6 a material belt with another arrangement of the punchings-out and, FIG. 7 a punched-out disc with an inner hole.

The punching machine shown in FIG. 1 to 4 consists of a lower part 1 and an upper part 2, which are firmly linked to one another through side parts 3. To the upper part 2 strips are fastened, on which punching carriages 5 and 6 are guided on rollers 7. The punching carriages 5 and 6 are moved via spindles 8 and 9. To the punching carriages 5 and 6, spindle nuts 10 are fastened. The spindles 8 and 9 are supported at 11 and 12 and driven via a belt drive of the motors 13 and 14.

The punching carriages 5 and 6 are brought via a control along their route into pre-determined positions. The control follows either in connection with a transmitter, eg on the spindle, or in connection with limit switches and cams along the route. These devices which are not portrayed are known per se.

The punching carriages 5 and 6 are developed in their upper part 5' and 6' as cylinders. Therein slide pistons 15 and 16, which carry at the lower end a tool receiver 17 and 18. Thereto tool stamps 19 and 20 are fastened. There holding down clamps (not portrayed) can also be fastened as well.

The cylinders 5' and 6' are linked via (not portrayed) flexible tube lines with valves of a hydraulic aggregate. In the lower part of the punching carriage 5, 6 tool die-plates 21 and 22 are fastened to abutments 23 and 24. The abutments are broken through, so that punched parts and waste can fall through. The abutments 23 and 24 are guided via rollers 25 on strips 26 which are fastened to the lower part 1. The rollers 25 can also be supported spring-suspended according to punch power, so that the abutments 23 and 24 can stay themselves against the strips 26 during the punching process.

Within the lower part 1 a transport band 27 for the punched parts (useful parts) 28 of the punching carriage 6 is attached. These fall through the broken through abutment 23 downwards onto the transport band 27 and are transported to the right out of the machine.

With the punching carriage 5 an inner hole is punched, in which case the waste falls downwards onto a slide 29 attached to the punching carriage 5 and from there sideways past the transport band 27 onto a transport band 30. This brings the waste out of the punching machine to the left.

To the punching machine a programme control also belongs, which controls the total course. It can be realized similarly, as is described in DE-OS No. 28 27 138.

The manner of working of the punching machine is described in the following, in which case it starts first of all from the starting place of the punching machine portrayed in FIG. 1:

The punching carriage 5 stands over a material belt 31 in a punching place. Through admission of the piston 16 it carries out a punching movement and punches out an inner hole. Thereupon the punching carriage 5 travels by one place to the left and realizes a further punching. This place can be seen in FIG. 3. Not until the next traverse does the punching carriage 6 travel likewise to the left over the first punching place of the punching carriage 5 and punches out the useful part 28. This falls downwards onto the transport band 27, which runs continuously.

The punching carriages 5 and 6 run to the left over the material belt 31 and punch at every halt so that punching pictures corresponding to FIG. 5 and 6 or similar arise.

As transport arrangement for step by step transport through the punching space a roll feed 32 is indicated in FIG. 2. However, a gripper transport can also be used.

In FIG. 4 both punching carriages are shown driven almost totally to the left. If the last punched part of a material belt has been punched out, both punching carriages travel back again into the starting place shown in FIG. 1. So that the punching carriages 5 and 6 can be driven over the total breadth of the material belt, the punching carriages 5 and 6 are developed u-shaped, in which case the upper legs 33 and 34 carry the cylinders 5' and 6', whilst the abutments 23 and 24 with the tool die-plates 21 and 22 are fastened to the free ends of the legs 35 and 36 lying below. The legs 33, 34 and 35, 36 are developed so long that, the punching carriages 5 and 6 can drive over the total breadth of the material belt 31. In the portrayed embodiment the distance between the middle of the tool stamp 19 and 20 and the outermost inner end of the linking parts 37 and 38 of the upper 33, 34 and lower legs 35, 36 corresponds to roughly the material belt breadth minus half the tool diameter. With this dimensioning it is guaranteed that, the total material can be reached by the punching tools.

The punching machine according to the invention can naturally also be tipped with only a single punching carriage, if namely parts without inner hole are to be punched. With the embodiment with two punching carriages, instead of a tool for the inner hole a further tool for the outer diameter can also be built in.

LIST OF REFERENCE TERMS:

1 lower part
2 upper part
3 side parts
4 strips on the upper part
5 punching carriage left
5' upper cylinder-shaped part of the punching carriage 5
6 punching carriage right
6' upper cylinder-shaped part of the punching carriage 6
7 rollers on the punching carriage above
8 spindle for 6
9 spindle for 5
10 spindle nut
11 support of the spindles
12 support of the spindles
13 motor for spindle 8
14 motor for spindle 9
15 piston right
16 piston left
17 tool receiver right
18 tool receiver left
19 tool stamp right
20 tool stamp left
21 tool die-plate right
22 tool die-plate left
23 abutment right
24 abutment left
25 rollers on the punching carriage below
26 strips on the lower part
27 transport band for useful parts
28 punched part (=useful part)
29 slide
30 transport band for waste
31 material belt
32 roll feed
33 upper leg of 5
34 upper leg of 6
35 lower leg of 5
36 lower leg of 6
37 linking part of 5
38 linking part of 6

What is claimed is:

1. A punching machine for punching a plurality of products having inner holes from a sheet of material, which is movable in a direction of advancement and which has a breadth transverse to such direction of advancement, across the entire breadth of the sheet of material, said machine comprising:

a rigid frame including a lower frame member and an upper frame member firmly connected together with a space therebetween, the sheet of material being moved through said space in the direction of advancement;

first and second punching carriages positioned in said space and mounted on said frame for movement relative thereto;

each said punching carriage having a U-shaped configuration including upper and lower legs joined by a connecting portion, a cylinder integral with a free end of said upper leg and movably receiving a piston supporting a punching tool, and an abutment integral with a free end of said lower leg and supporting a die plate complementary to said punching tool and precisely aligned therewith, the distance between the middle of said punching tool and the innermost surface of said connecting portion being equal substantially to the breadth of the sheet of material minus half the diameter of said punching tool, such that said punching tool of each said punching carriage is movable over the entire breadth of the sheet of material;

said punching tool and die plate of said first punching carriage being dimensioned to punch the inner holes of the products to be punched from the sheet of material, and the punching tool and die plate of said second punching carriage being dimensioned to punch the outer contour of the products from the sheet of material; and means for moving sequentially first said first punching carriage and then said second punching carriage, relative to said frame in a direction transverse to the direction of advancement of the sheet of material, to a plurality of predetermined punching positions at each of which first the inner hole of a product is punched and then the outer contour thereof is punched.

2. A machine as claimed in claim 1, wherein said moving means includes threaded spindles rotatably mounted on said frame, and internally threaded members fastened to said punching carriages and threaded on said spindles, such that rotation of said spindles causes movement of said threaded members and said punching carriages longitudinally of said spindles.

3. A machine as claimed in claim 2, wherein each said punching carriage is moved by a respective said spindle which is rotatable independently of rotation of other said spindles.

4. A machine as claimed in claim 1, further comprising conveyor means positioned beneath said punching carriages for removing waste from the punching of the inner holes and for separately removing punched products.

5. A machine as claimed in claim 1, further comprising guide members extending in directions parallel to said transverse direction and mounted on said lower frame member and on said upper frame member, said punching carriages being supported by said guide members.

* * * * *